US006921061B2

(12) United States Patent
Hayashi et al.

(10) Patent No.: US 6,921,061 B2
(45) Date of Patent: Jul. 26, 2005

(54) HOISTING APPARATUS WITH HORIZONTAL STABILIZING MEANS FOR A LOAD HOLDER

(75) Inventors: Kenichiro Hayashi, Shijonawate (JP); Toshiyuki Shimizu, Higashiosaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 51 days.

(21) Appl. No.: 10/718,661

(22) Filed: Nov. 24, 2003

(65) Prior Publication Data

US 2004/0195553 A1 Oct. 7, 2004

(30) Foreign Application Priority Data

Feb. 27, 2003 (JP) ..... 2003-051262

(51) Int. Cl.[7] ..... B66D 1/34
(52) U.S. Cl. ..... 254/373; 254/278
(58) Field of Search ..... 254/278, 371, 254/372, 373, 374

(56) References Cited

U.S. PATENT DOCUMENTS 1,092,670 A * 4/1914 Smith ..... 254/278
4,927,537 A * 5/1990 Meurer ..... 210/527
4,986,915 A * 1/1991 Meurer ..... 210/527
6,102,372 A * 8/2000 Gersemsky et al. ..... 254/278
6,105,938 A * 8/2000 Koida ..... 254/278

FOREIGN PATENT DOCUMENTS

EP 1 193 442 A2 4/2002

* cited by examiner

*Primary Examiner*—Emmanuel Marcelo
(74) *Attorney, Agent, or Firm*—Rader, Fishman & Grauer PLLC

(57) ABSTRACT

A hoisting apparatus with a horizontal stabilizing means for a load holder is provided. This apparatus comprises a base secured to a ceiling, a load holder, to which a load is detachably attached, a pair of cables extending between the base and the load holder, and a drive means mounted on the base, which is operative to take in or let out the cables from the base. The horizontal stabilizing means includes a shaft horizontally supported in the load holder to be freely rotatable, around which the cables are wound in opposite winding directions to each other. The horizontal stabilizing means is operative to correct an inclination of the load holder in a horizontal position by unwinding a required length of one of the cables from the shaft and at the same time winding the same length of the other one around the shaft.

8 Claims, 9 Drawing Sheets

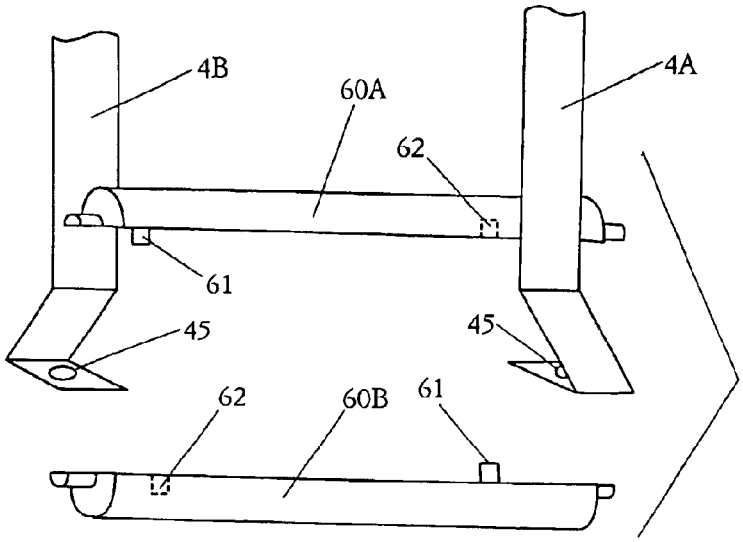
FIG. 8A
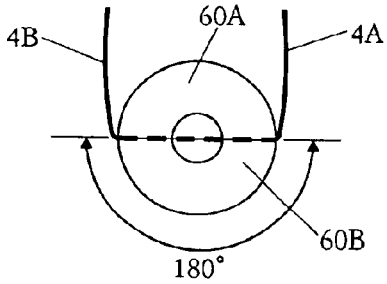
FIG. 8B
FIG. 9A
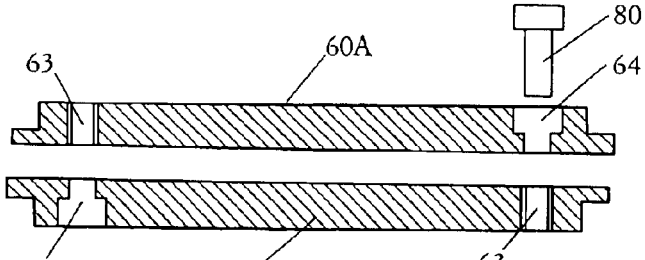
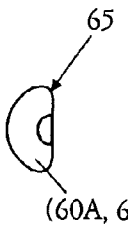
FIG. 9B
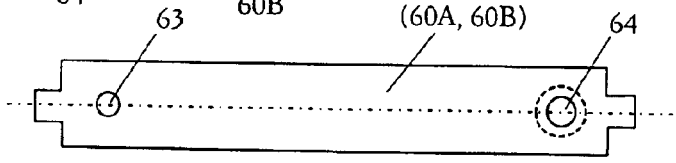
FIG. 9C

HOISTING APPARATUS WITH HORIZONTAL STABILIZING MEANS FOR A LOAD HOLDER

BACKGROUND OF THE INVENTION

1. Field of the Invention

The present invention relates to a hoisting apparatus for a load such as luminaires used at high elevations, and particularly a hoisting apparatus with a horizontal stabilizing means for a load holder, to which the load is detachably attached.

2. Disclosure of the Prior Art

In high-ceilinged structures such as concert hall, gymnasium, and convention hall, a hoisting apparatus has been utilized to readily carry out maintenance work of luminaires operated at high elevations. For example, as shown in FIG. 10, European Patent Publication No. 1193442 A2 discloses this kind of hoisting apparatus. That is, this hoisting apparatus 1S is mainly composed of a base 2S secured to a ceiling, a load holder 3S, to which a luminaire is detachably attached, a pair of cables 4S extending between the base and the load holder, a drive unit (not shown) mounted to the base, to which one ends of the cables are connected, so that the drive unit is operative to take in or let out the cables from the base.

From the viewpoint of facilitating the maintenance work of the luminaire under safe working condition, this hoisting apparatus also has a cable-length adjusting means in the load holder 3S, by which the cable length can be readily adjusted such that a descending position of the load holder matches a position adequate for the maintenance work of the luminaire to avoid dangerous operations at high elevations, As shown in FIGS. 11A to 11C, the cable-length adjusting means comprises a winding shaft 60S of a round-bar shape, which is rotatably supported in a holder case 30S of the load holder 3S. Each of the cables 4S is fixed connected at its one end to a winding drum (not shown) of the drive unit and at the opposite end to the winding shaft 60S. The winding shaft 60S also has an elongate hole 64S, to which a dedicated tool 48S can be inserted through a slit 34S formed in the upper surface of the holder case 30S to inhibit the rotation of the winding shaft. In addition, the winding shaft 60S has engagement grooves 65S at its opposite ends, to which a tip of the dedicated tool 48S can be engaged. The grooves 65S of the winding shaft 60S are exposed to be accessible from outside of the holder case 30S, as shown in FIG. 10.

By use of the cable-length adjusting means described above, the cable length can be adjusted as follows. That is, the tip of the dedicated tool 48S is engaged to one of the grooves 65S of the winding shaft 60S, and then the winding shaft is rotated by the dedicated tool to wind desired amounts of the cables thereon. In this hoisting apparatus, since both of the cables 4S are wound around the winding shaft 60S in the same winding direction, as shown in FIG. 11A, the winding operation of the cables can be achieved by rotating the winding shaft 60S. In addition, since a proper tension is applied to the cables 4S under the suspended condition of the load holder 3S, it is possible to readily wind the cables around the winding shaft 60S without looseness. After the desired amounts of the cables 4S are wound on the winding shaft 60S, the dedicated tool 48S is removed from the groove 65S, and inserted into the elongate hole 64S of the winding shaft through the slit 34S of the holder case 30S, so that the rotation of the winding shaft is inhibited to prevent unwinding of the cables 4S from the winding shaft.

By the way, from another viewpoint of preventing an inclination of the load holder with the luminaire, an improvement of the conventional hoisting apparatus is being awaited. For example, due to variations in cable length, and variations in position of the cable ends respectively connected to the winding shaft and the winding drum of the drive unit, it is difficult to provide the same effective length between the pair of cables. This means that the inclination of the load holder may easily occurs.

According to the hoisting apparatus described above, it is possible to adjust the cable length by rotating the winding shaft to obtain the desired effective length of the cables between the base and the load holder. However, since both of the cables are wound around the winding shaft in the same winding direction, this cable-length adjusting means do not have a function of correcting the inclination of the load holder in a horizontal position. In other words, when one of the cables is wound around the winding shaft by rotating the winding shaft, the other one is also wound around the winding shaft. Therefore, the inclination of the load holder can not be solved by the rotation of the winding shaft.

Thus, from the above viewpoint of stably maintaining the load holder in a horizontal position, there is still room for improvement of the conventional hoisting apparatus.

SUMMARY OF THE INVENTION

Therefore, a primary concern of the present invention is to provide a hoisting apparatus with a horizontal stabilizing means, which has the capability of preventing the occurrence of an inclination of a load holder to stably keep a load holder in a horizontal position without separately installing a complex mechanism for horizontally stabilizing the load holder.

That is, the hoisting apparatus of the present invention comprises a base secured to a ceiling, a load holder, a pair of first and second cables extending between the base and the load holder, a drive unit mounted to the base, and the horizontal stabilizing means for the load holder. A load such as a luminaire is detachably attached to the load holder. One end of each of the first and second cables is connected to the drive unit, so that the drive unit is operative to take in or let out the first and second cables from the base. The horizontal stabilizing means includes a shaft horizontally supported in the load holder to be freely rotatable. The first cable is connected at its opposite end to an end portion of the shaft, and wound around the shaft in a first winding direction. On the other hand, the second cable is connected at its opposite end to an opposite end portion of the shaft, and wound around the shaft in a second winding direction opposite to the first winding direction.

According to the present invention, when there is a difference between the first and second cables with respect to an effective length defined as a cable length between the base and the load holder, it becomes a cause of an inclination of the load holder. In this case, since the cable having a shorter effective length receives a larger tension due to a total weight of the load holder and the load attached to the load holder, the horizontal stabilizing means is operative to correct the inclination of the load holder in a horizontal position by unwinding a required length of the cable having the shorter effective length from the shaft and at the same time winding the same length of the other cable around the shaft.

In other words, when the effective length of the first cable has a smaller than that of the second cable, an inclination of the load holder happens such that the end portion of the shaft connected to the first cable is elevated at a higher position than the opposite end portion of the shaft connected to the second shaft. At this time, the inclination of the load holder allows the shaft to rotate in direction of unwinding the first cable. From the standpoint of the second cable, the rotation of the shaft provides a winding operation of the second cable around the shaft because the first and second cables are wound around the shaft in opposite winding directions to each other. Therefore, as soon as the inclination of the load holder happens, it can be cancelled out by the unwinding motion of the first cable and the winding motion of the second cable, so that the load holder is always stably maintained in the horizontal position.

In a preferred embodiment of the present invention, the load holder has a housing for incorporating the shaft therein, and the shaft is placed in the housing such that a center of gravity of the load holder with the load is positioned on a vertical line extending downwardly from a center point on the shaft between the first and second cables. In this case, since the shaft receives the gravity in a balanced manner, it is possible to achieve the operation of the horizontal stabilizing means with a higher degree of reliability.

In another preferred embodiment of the present invention, the first and second cables are of a pair of strip cables. The load holder includes a housing for incorporating the shaft therein, which has a pair of slits for passing the strip cables therethrough in its top surface. The slits are spaced from each other in an axial direction of the shaft by a required distance, and one of the slits is displaced from the other one in a direction perpendicular to the axial direction. In this case, it is possible to provide a smooth hoisting operation of the load holder, while preventing a pivot motion of the load holder about a vertical axis as well as the inclination of the load holder.

It is also preferred that the first and second cables are of a pair of strip cables, and the load holder includes a housing, in which a space for incorporating the shaft therein is defined, and the housing has a pair of slits for passing said strip cables therethrough in its top surface, and a pair of guide projections each having a curved top for guiding said strip cables into said slits, which project in the space above the shaft. In this case, since each of the cables is guided to the slit through a surface contact of the strip cable with the curved of the guide projection, it is possible to minimum physical damage to the cable. In addition, there is an advantage that the winding/unwinding operations of the cables become smooth.

Another concern of the present invention is to provide a load holder of the hoisting apparatus described above. That is, the load holder comprises a housing having a bottom, to which a load is detachably attached, a horizontal stabilizing means including a shaft horizontally supported in the housing to be freely rotatable, and a pair of cables, which are connected at its one ends to opposite end portions of the shaft, and wound around the shaft in opposite winding directions to each other. Under a suspended state of the load holder, the horizontal stabilizing means is operative to correct an inclination of the load holder in a horizontal position by unwinding a required length of one of said cables from the shaft and at the same time winding the same length of the other one around the shaft.

These and still other objects and advantages will become apparent from the following detail description of the invention according to preferred embodiments with the attached drawings.

BRIEF EXPLANATION OF THE DRAWINGS

FIG. 8A is an exploded perspective view of a shaft of the horizontal stabilizing means, and FIG. 8B is an end view of the shaft connected to cables;

FIGS. 9A to 9C respectively are a cross-sectional view, end view and a plan view of an elongate piece as a modification of the shaft;

DETAIL DESCRIPTION OF THE INVENTION

According to preferred embodiments, a hoisting apparatus of the present invention is explained below in detail. A load to be attached to the hoisting apparatus is not specifically limited, but comprises articles such as a luminaire, camera for crime prevention, fire alarm, and a curtain, which are used at high elevations and lifted down from the high elevations for maintenance.

Figure 1:
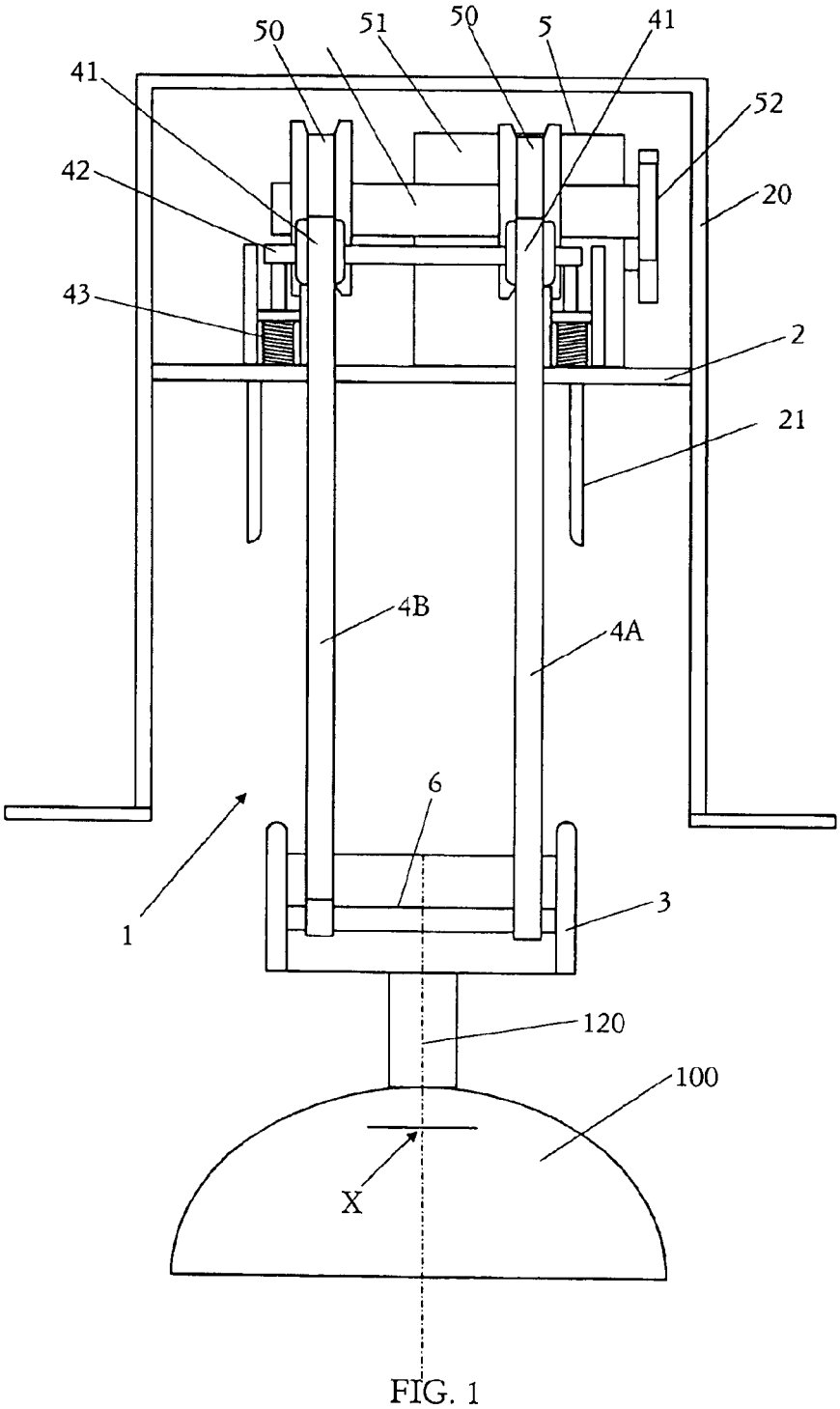
FIG. 1 is a schematic view of a hoisting apparatus according to a preferred embodiment of the present invention.
Figure 2:
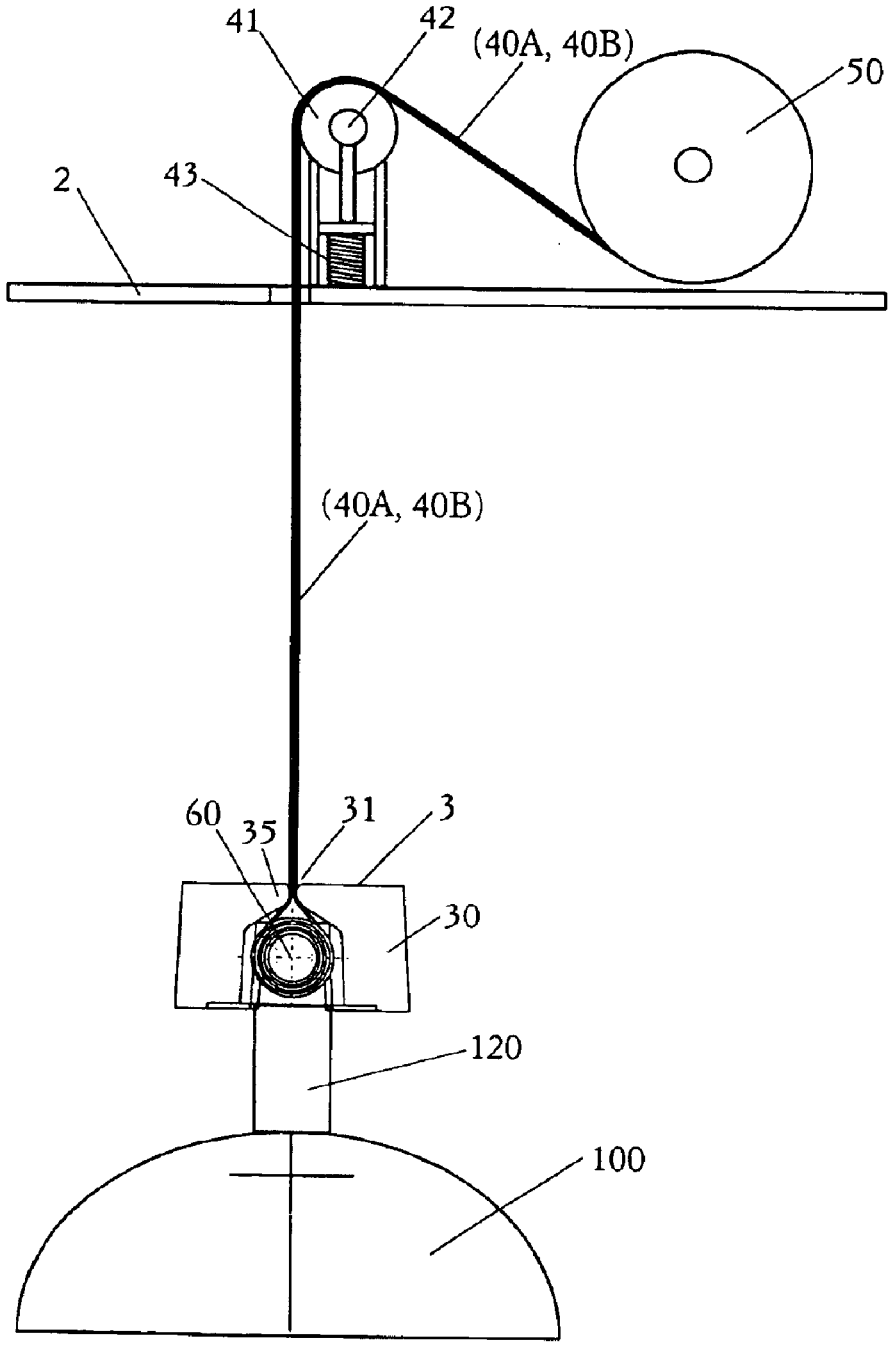
FIG. 2 is a schematic diagram showing a cable configuration of the hoisting apparatus.

As shown in FIGS. 1 and 2, the hoisting apparatus 1 of the present embodiment comprises a base 2 secured to a ceiling of a structure, a load holder 3, to which a load such as a luminaire 100 is detachably attached, a pair of first and second cables (4A, 4B) extending between the base and the load holder, a drive unit 5 mounted to the base 2 that is operative to take in or let out the first and second cables from the base, and a horizontal stabilizing means 6 for the load holder 3.

The base 2 has a case 20 having a bottom opening, through which the load holder 3 with the luminaire 100 can be housed in the case. In addition, guide walls 21 are formed in the case 20 such that a holder space surrounded by the guide walls receives the load holder 3. Therefore, when the load holder with the luminaire is moved upwardly in to the case 20, it is possible to prevent an accidental collision of the luminaire with the case because the load holder 3 is smoothly guided to the holder space by the guide walls 21.

The drive unit 5 is mounted on the base 2 in the case 20. The drive unit 5 comprises a pair of winding drums 50, to which one ends of the cables (4A, 4B) are connected, DC motor 51 with a permanent magnet and a rectifier brush to rotate the winding drums, and a reduction-gearing unit 52 for transmitting a power output of the DC motor to the winding drums. The reduction-gearing unit 26 has a self-lock mechanism for preventing a situation that a rotation of the winding drums is transmitted in reverse to the DC motor 51 when the DC motor is in a rest condition. In place of the DC motor, an AC motor may be used. In addition, the top of the case 20 may be provided by a detachable cover. In this case, it is possible to readily carry out maintenance of the drive unit and adjust an effective length of the cables (4A, 4B) defined as a cable length between the base 2 and the load holder 3 by removing the detachable cover from the case.

It is preferred that the cables (4A, 4B) are a pair of strip cables made of a metal material having high stiffness. As shown in FIG. 2, each of the cables (4A, 4B) is connected to the winding drum 50 at its one end, and extends vertically toward the load holder 3 through a sheave 41. The cables extend in a substantially same plane such that the first cable 4A is in parallel with the second cable 4B. The sheaves 41 are attached to a rotational bar 42 so as to be spaced from each other by a required distance. Each of the ends of the rotational bar 42 are supported by spring member 43, so that the rotational bar 42 can move up and down together with the sheaves 41. Therefore, a mechanical shock caused by a change in tension of the cables can be absorbed by the spring members 43. For improving the safety of the hoisting apparatus, it is preferred that the vertical movement of the rotational bar is detected by a sensor (not shown), and the winding/unwinding operations of the cables is controlled according to an output of the sensor.

Figure 3:
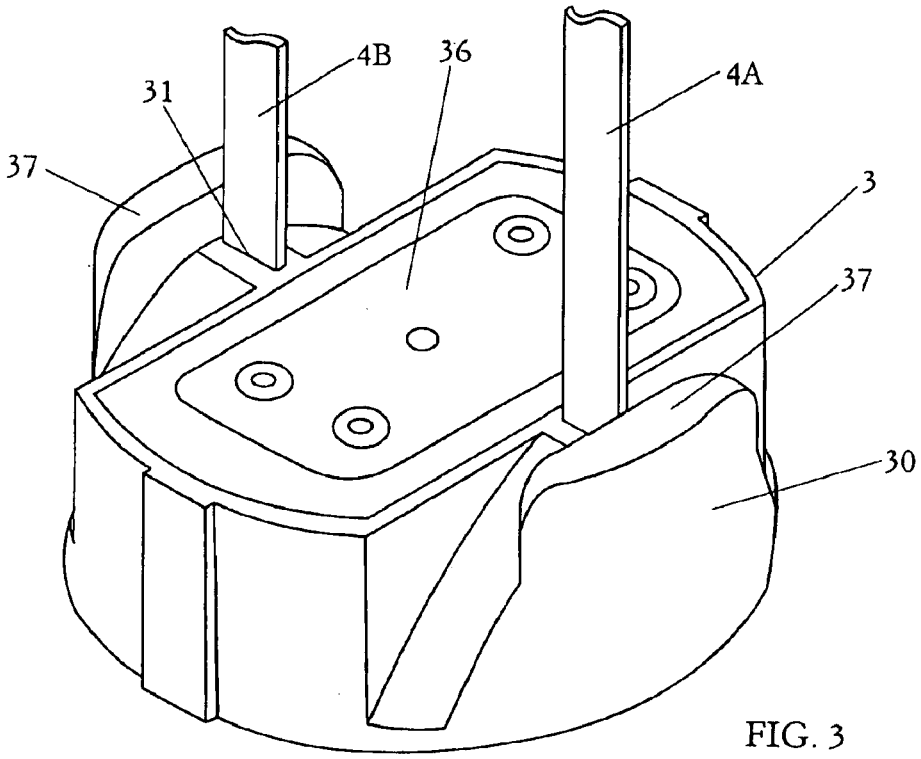
FIG. 3 is a perspective view of a load holder of the hoisting apparatus.
Figure 5:
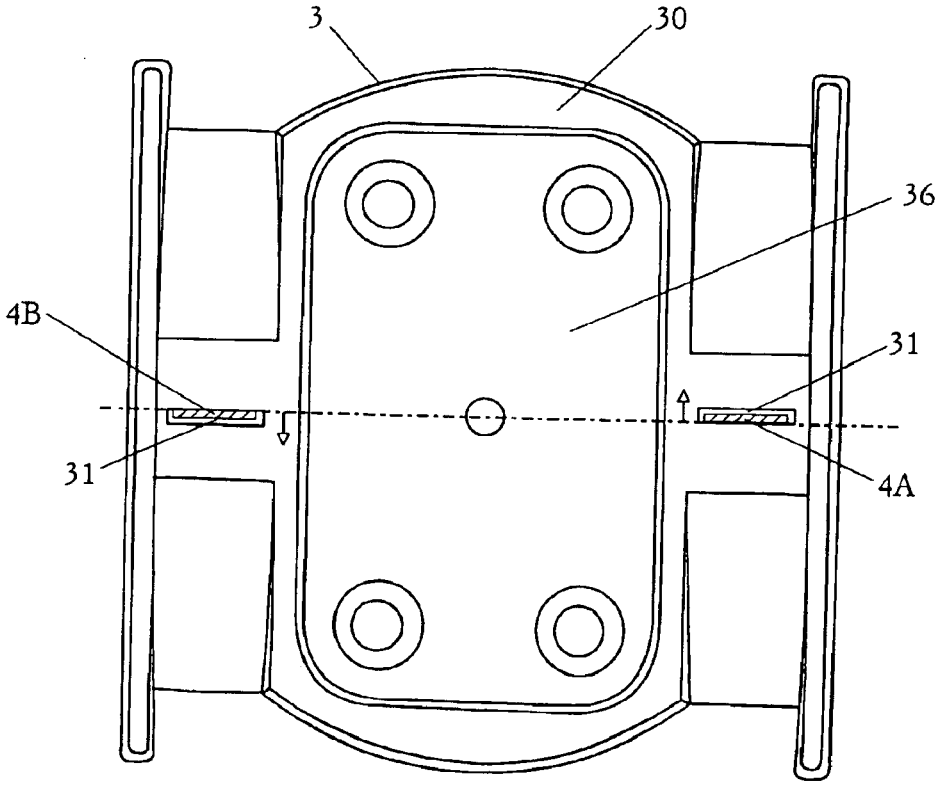
FIG. 5 is a top view of the load holder.
Figure 4A:
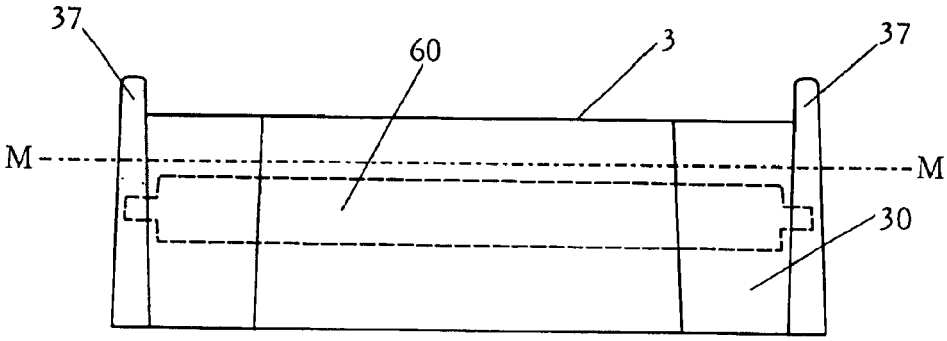
FIG. 4A is a side view of the load holder.
Figure 4B:
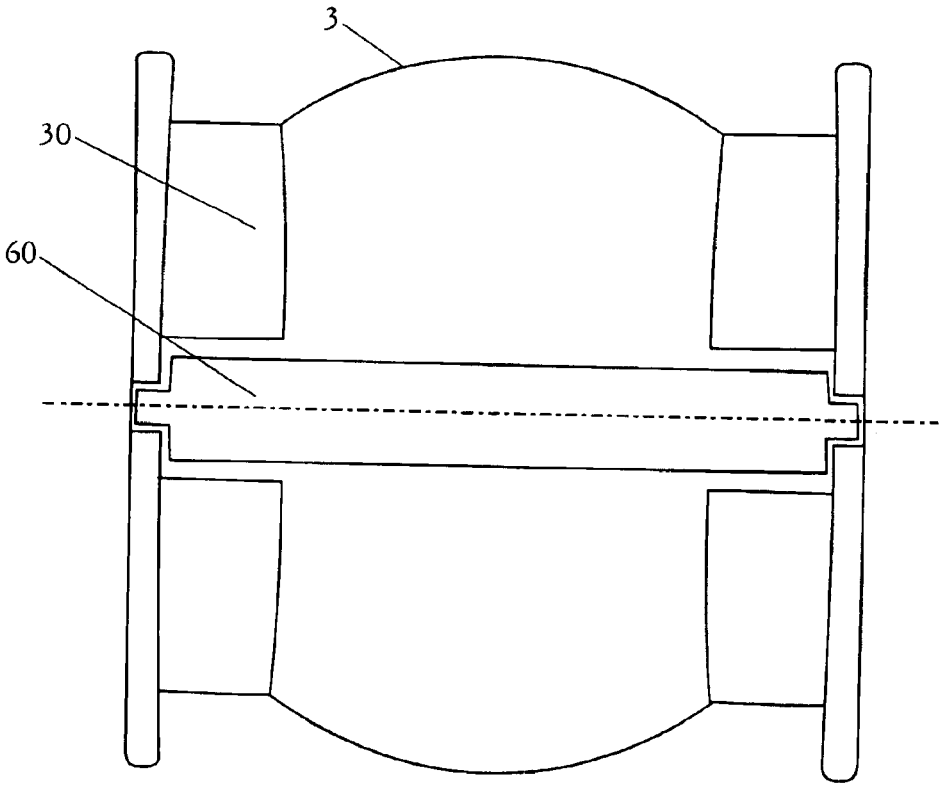
FIG. 4B is a horizontal cross-sectional view of the load holder taken along the line M—M of FIG. 4A.

As shown in FIG. 3, the load holder 3 has a disk-shaped housing 30, to a bottom of which the luminaire 100 as the load is detachably attached. The horizontal stabilizing means 6 includes a shaft 60 horizontally supported in the housing 30 to be freely rotatable by use of bearings (not shown), as shown in FIGS. 4A and 4B. Opposite ends of the cables (4A, 4B) are inserted in the housing 30 through a slit 31 formed in a top surface of the housing, as shown in FIG. 5, and connected to the shaft 60. In FIGS. 1 and 2, the numeral 120 designates a connector adapted to electrically and mechanically connect the luminaire 100 with the load holder 3. The attaching operation of the luminaire to the load holder can be performed by use of conventional fixtures selected according to a kind of the luminaire.

According to the hoisting apparatus with the above-described components, by starting the DC motor 51, the load holder 3 can be traveled between a top position where the load holder is fitted in the case 20, and a bottom position where the cables are unwound (released) from the winding drums 50 so that the load holder 3 is spaced from the base 2 by a required distance to carry out the maintenance of the load under a safe condition.

Figure 6A:
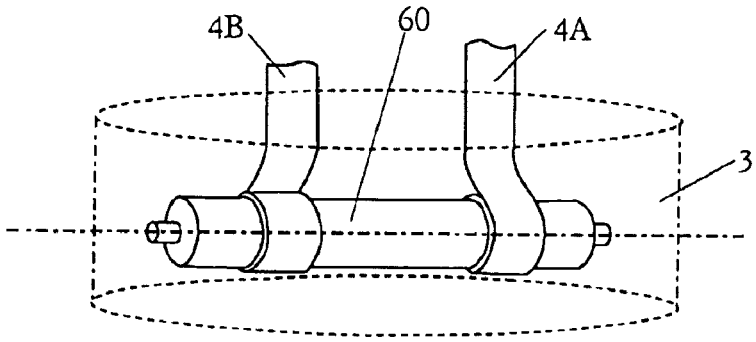
FIG. 6A is a perspective view of a horizontal stabilizing means of the hoisting apparatus.
Figure 6B:
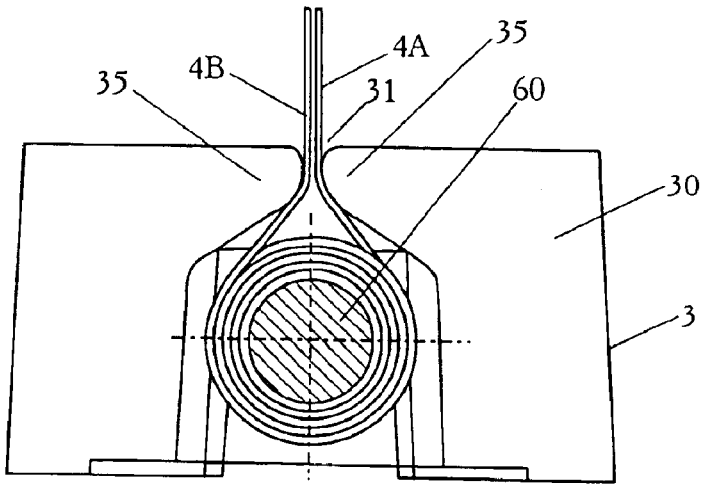
FIGS. 6B and 6C are partially cross-sectional views of the load holder.
Figure 6C:
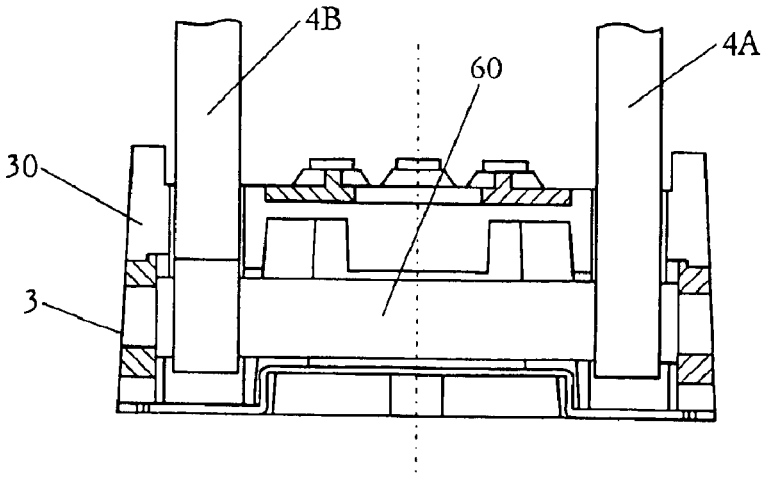

As shown in FIGS. 6A to 6C, the most important configuration of the present hoisting apparatus is characterized in that the first cable 4A is connected to an end portion of the shaft 60, and wound around the shaft in a first winding direction, and the second cable 4B is connected to an opposite end portion of the shaft 60, and wound around the shaft in a second winding direction opposite to the first winding direction. In short, the first and second cables (4A, 4B) are wound around the shaft 60 in opposite winding directions to each other. According to this configuration, when an inclination of the load holder 3 occurs, the shaft 60 of the horizontal stabilizing means voluntarily rotates to unwind a required length of the first cable from the shaft and at the same time wind the same length of the second cable around the shaft under a condition that a total weight of the load holder 3 and the luminaire 100 as the load is applied to the cables (4A, 4B) through the shaft, thereby correcting the inclination of the load holder in a horizontal position.

Figure 7A:
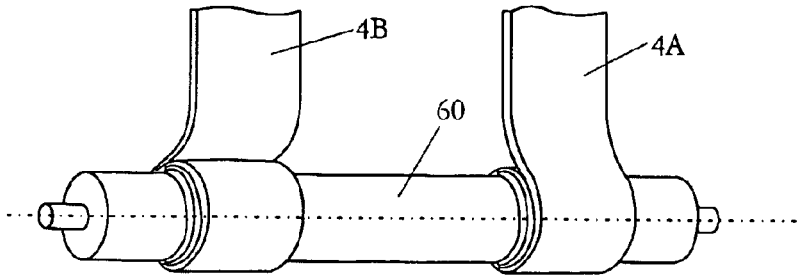
FIGS. 7A to 7C are conceptual diagrams for understanding operations of the horizontal stabilizing means.
Figure 7B:
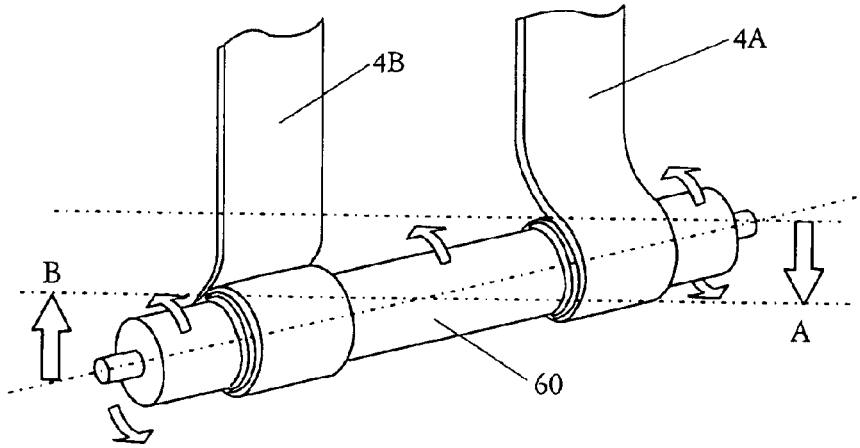
Figure 7C:
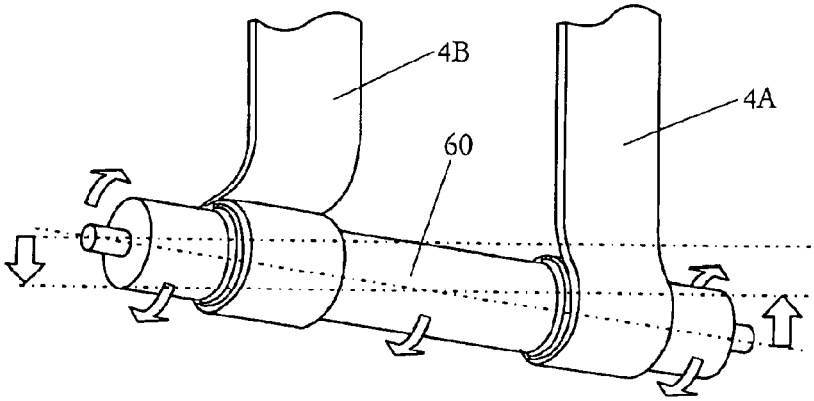
Figure 10:
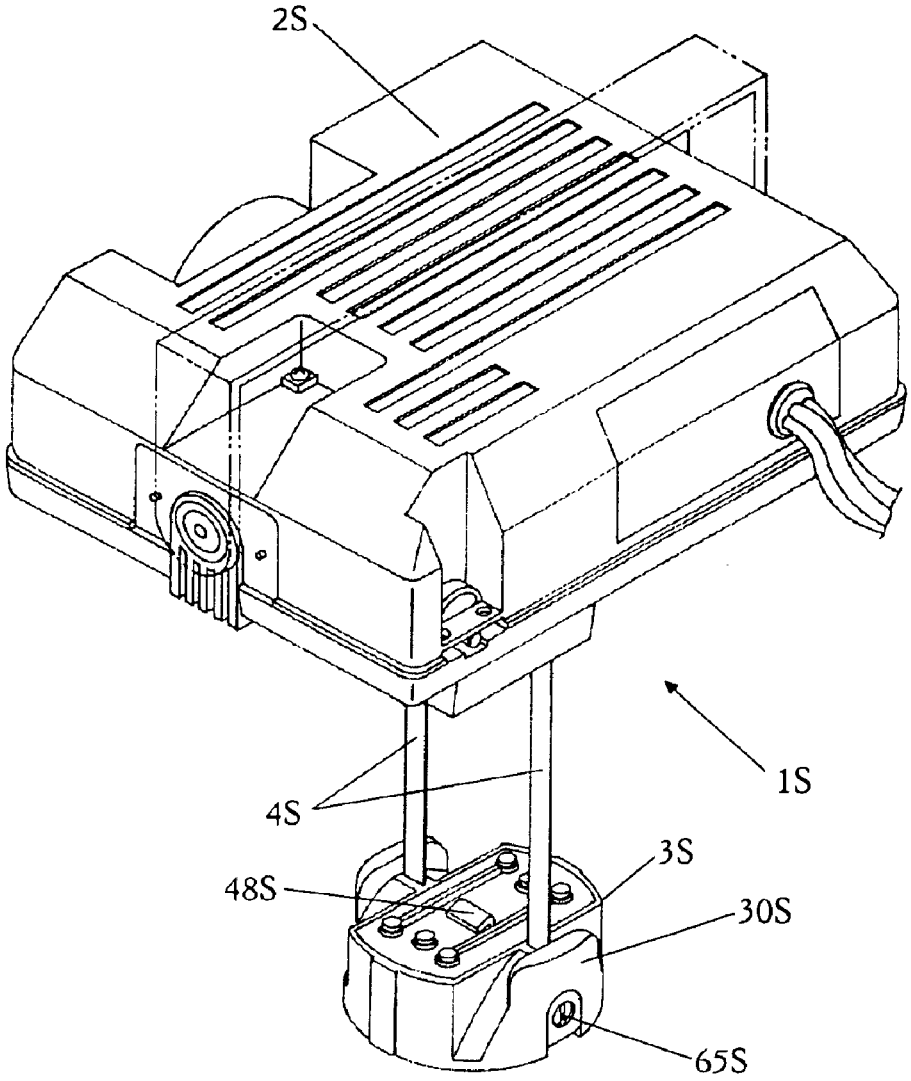
FIG. 10 (Prior Art)
FIG. 10 is a perspective view of a conventional hoisting apparatus.
Figure 11A:
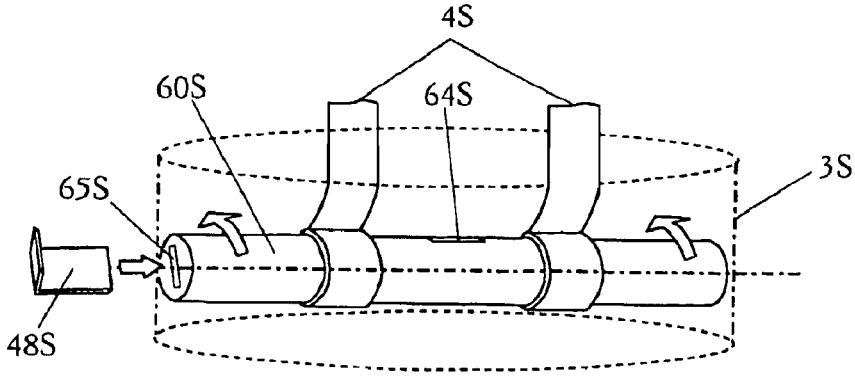
FIG. 11A (Prior Art)
FIG. 11A is a perspective view of a cable-length adjusting means of the conventional hoisting apparatus.
Figure 11B:
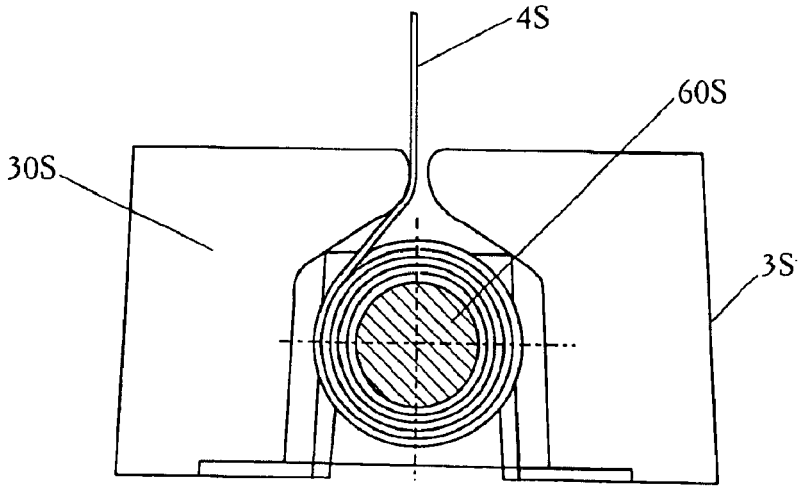
FIG. 11B (Prior Art)
FIGS. 11B and 11C are partially cross-sectional views of the load holder of FIG. 10.
Figure 11C:
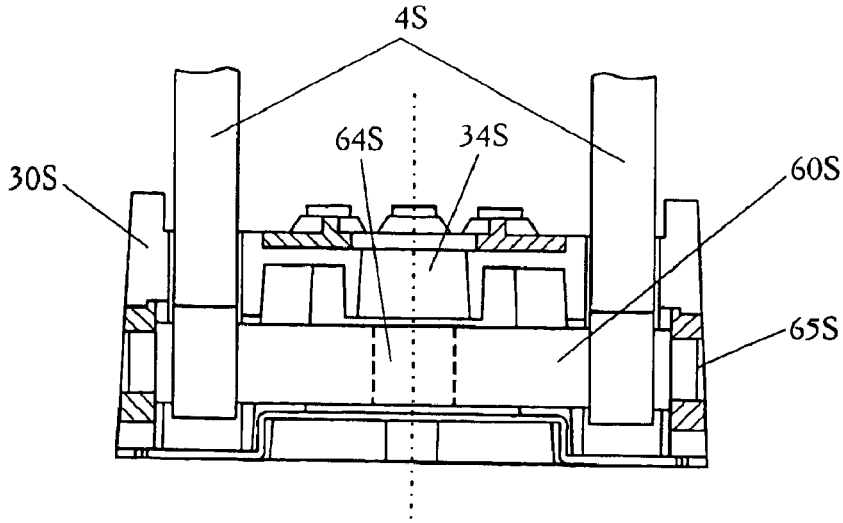
FIG. 11C (Prior Art)

A mechanism of the horizontal stabilizing means of the present invention is further explained referring to FIGS. 7A to 7C. When the load holder 3 is maintained in a horizontal position, as shown in FIG. 7A, the effective length of the first cable 4A between the base 2 and the load holder is substantially equal to the effective length of the second cable 4B. However, when the effective length of the first cable 4A becomes shorter than that of the second cable 4B for some reason, as shown in FIG. 7B, an inclination of the shaft 60 occurs. In this case, the first cable 4A receives a larger tension, i.e., a larger part of the total weight of the load holder 3 and the luminaire 100 attached to the load holder, than the second cable 4B. Such an unbalance of the tension between the first and second cables becomes a driving force for allowing the shaft 60 to voluntarily rotate in the direction shown by the curved arrows in FIG. 7B. By this rotation of the shaft 60, a length of the first cable 4A is unwind (released) from the shaft, so that the end portion of the shaft connected to the first cable is moved downwardly, as shown by the arrow "A" in FIG. 7B. On the other hand, by the rotation of the shaft, the same length of the second cable 4B is wound around the shaft 60, so that the opposite end portion of the shaft connected to the second cable is moved upwardly, as shown by the arrow "B" in FIG. 7B. Thus, as soon as the inclination of the load holder 3 happens, it can be cancelled out by the unwinding motion of the first cable and the winding motion of the second cable, so that the load holder is always maintained in a horizontal position. As a result, it is possible to smoothly move the load holder up and down, while maintaining the horizontally-stabilized posture of the load holder.

Similarly, when the effective length of the first cable 4A becomes longer than that of the second cable 4B for some reason, an inclination of the shaft 60 occurs, as shown in FIG. 7C. In this case, the unwinding motion of the second cable 4B and the winding motion of the first cable 4A are simultaneously achieved by the rotation of the shaft in an opposite direction to the case of FIG. 7B, so that the inclination of the load holder can be instantly solved. In the present embodiment, each of the first and second cables (4A, 4B) is wound at plural number of times around the shaft 60. However, each of the first and second cables may be wound around the shaft by only a length corresponding to a half of circumference of the shaft.

A preferred embodiment of the shaft 60 of the horizontal stabilizing means is explained. As shown in FIG. 8A, this shaft is formed with a pair of elongate pieces (60A, 60B) that are separable along its axial direction. Each of the elongate pieces has a projection 61 and a hole 62, which are formed such that the projection of one of the elongate pieces can be fitted in the hole of the other one. In the case of fixing the ends of the first and second cables to this shaft, the projections 61 are pushed into the holes 62 through apertures 45 formed at the ends of the first and second cables (4A, 4B). At this time, as shown in FIG. 8B, the first and second cables are caught between those elongate pieces such that a direction of inserting the end of the first cable 4A into a gap between the elongate pieces is different from the direction of inserting the end of the second cable 4B in the gap between the elongate pieces by 180 degrees around the shaft.

In place of the separable shaft shown in FIGS. 8A and 8B, another separable shaft shown in FIGS. 9A to 9C may be used. This shaft is composed of a pair of elongate pieces (60A, 60B) each having a screw hole 63 and a hole 64 for receiving a screw head at its both end portions. In this case, each of the ends of the first and second cables (4A, 4B) can be fixed to shaft by positioning a center of the screw hole 63 of one of the elongate pieces so as to be in agreement with a center of the corresponding hole 64 of the other one through the aperture 45 of the cable, and then tightening a screw 80 inserted into the screw hole. By the way, when sides of the elongate piece (60A, 60B) in the longitudinal direction have a sharp edge, there is a fear that a damage of the cables is caused by a contact between the cable and the shape edge. In such a case, it is preferred that the both sides of the elongate piece have rounded corner portions 65, as shown in FIG. 9B.

To obtain the operation of the horizontal stabilizing means 6 according to the above-described mechanism with a higher degree of reliability, it is preferred that a center "X" of gravity of the load holder 3 with the luminaire 100 as the load is on a vertical line extending downwardly from a center point on the shaft 60 between the first and second cables (4A, 4B), as shown in FIG. 1.

In addition, as shown in FIG. 6B, it is preferred that the housing 30 of the load holder 3 has a pair of guide projections 35 each having a curved top for guiding the respective cable into the slit 31. As described above, the cables receive the large tension under the suspended condition of the load holder 3. Therefore, when the cable makes a contact with a sharp corner portion of the holder case 30, it may lead to a reduction in life of the cable. In this embodiment, since each of the cables (4A, 4B) provided from the shaft 60 makes a surface contact with the curved top of the guide projections 35, as shown in FIG. 6B, it is possible to effectively prevent the reduction in life of the cable.

As described above, in the present invention, since the first and second cables (4A, 4B) are wound around the shaft 60 in the opposite winding directions, the first cable 4A is pushed against the curved top of the guide projection 35 shown at the right side of FIG. 6B, and on the contrary the second cable 4B is pushed against the curved top of the guide projection 35 shown at the left side of FIG. 6B. Therefore, for example, it is preferred that the slits 31 for the first and second cables (4A, 4B) are displaced from each other in a direction perpendicular to the axial direction of the shaft 60, as shown by the arrows of FIG. 5. In this case, it is possible to allow surfaces of the first and second cables (4A, 4B) to extend on a vertical plane including the axis of the shaft 60, and thereby provide a smooth hoisting motion, while minimizing a swinging of the load holder.

In addition, when the winding/unwinding operation of the cables are repeated, static electricity is easily generated at the shaft 60 and the guide projections 35. To release the static electricity from the housing 30 of the load holder 3, it is also preferred that the top surface of the housing is formed by an insulation plate 36.

Moreover, as shown in FIG. 4A, the housing 30 has a pair of protrusions 37 extending upward from its rim in order to prevent a situation that the load holder 3 suspended by the cables is accidentally rotated about a horizontal axis to cause a kink in the cables. Each of the protrusions 37 is formed at a position adjacent to the cable under the suspended condition of the load holder 3, as shown in FIG. 3. The protrusion 37 also has an arcuate top shape, which is effectively used as guide means for smoothly introducing the load holder 3 into the space surrounded by the guide walls 21 of the base 2. In addition, it is preferred that edges of the protrusions 37 are rounded to prevent the cables from damages when the cables accidentally contact with the protrusions 37.

As understood from the above embodiments, the present invention provides a hoisting apparatus with a horizontal stabilizing means for the load holder having the capability of instantly recovering an inclination of the load holder in a horizontal position irrespective of its relatively simple configuration. Therefore, the hoisting apparatus of the present invention will be preferably used in applications of requiring smooth up and down movements of the load, while always keeping the load in the horizontal position. In addition, there is another advantage that the same effects brought by the present hoisting apparatus can be achieved by use of a load holder of the present invention in place of the load holder of the existing hoisting apparatus. Thus, since the load holder of the present invention is excellent in cost performance, it will be widely utilized in the existing hoisting apparatus as well as the hoisting apparatus of the present invention.

What is claimed is:

1. A hoisting apparatus comprising:

a base secured to a ceiling;

a load holder, to which a load is detachably attached;

a pair of first and second cables extending between said base and said load holder;

a drive means mounted to said base, to which one ends of said first and second cables are connected, so that said drive means is operative to take in or let out said first and second cables from said base; and a horizontal stabilizing means for said load holder including a shaft horizontally supported in said load holder to be freely rotatable, wherein said first cable is connected at its opposite end to an end portion of said shaft, and wound around said shaft in a first winding direction, and said second cable is connected at its opposite end to an opposite end portion of said shaft, and wound around said shaft in a second winding direction opposite to the first winding direction.

2. The hoisting apparatus as set forth in claim 1, wherein said load holder has a housing for incorporating said shaft therein, and said shaft is placed in said housing such that a center of gravity of said load holder with said load is positioned on a vertical line extending downwardly from a center point on said shaft between said first and second cables.

3. The hoisting apparatus as set forth in claim 1, wherein said first and second cables are of a pair of strip cables, and said load holder includes a housing for incorporating said shaft therein, which has a pair of slits for passing said strip cables therethrough in its top surface, and wherein said slits are spaced from each other in an axial direction of said shaft by a required distance, and one of said slits is displaced from the other one in a direction perpendicular to the axial direction.

4. The hoisting apparatus as set forth in claim 1, wherein said first and second cables are of a pair of strip cables, and said load holder includes a housing, in which a space for incorporating said shaft therein is defined, and wherein said housing has a pair of slits for passing said strip cables therethrough in its top surface, and a pair of guide projections each having a curved top for guiding said strip cables into said slits, which project in said space above said shaft.

5. The hoisting apparatus as set forth in claim 1, wherein said shaft is formed with a pair of elongate pieces that are separable along its axial direction, and wherein the opposite ends of said first and second cables are caught between said elongate pieces such that a position of inserting the opposite end of said first cable in a gap between said elongate pieces is spaced from the position of inserting the opposite end of said second cable in the gap between said elongate pieces by 180 degrees around said shaft.

6. The hoisting apparatus as set forth in claim 1, wherein said first and second cables are of a pair of strip cables, said load holder includes a housing for incorporating said shaft therein, which has a pair of slits for passing said strip cables therethrough in its top surface, and a pair of protrusions extending upwardly from its rim adjacent to said strip cables to prevent such a situation that said load holder suspended from said base be accidentally rotated about a horizontal axis to cause a kink in said strip cables.

7. A hoisting apparatus comprising:

a base secured to a ceiling;

a load holder, to which a load is detachably attached;

a pair of cables extending between said base and said load holder;

a drive means mounted to said base, which is operative to take in or let out said cables from said base; and a horizontal stabilizing means for said load holder including a shaft horizontally supported in said load holder to be freely rotatable, around which said cables are wound in opposite winding directions to each other, wherein said horizontal stabilizing means is operative to correct an inclination of said load holder in a horizontal position by unwinding a required length of one of said cables from said shaft and at the same time winding the same length of the other one around said shaft.

8. A load holder for a hoisting apparatus, said load holder comprising:

a housing having a bottom, to which a load is detachably attached;

a horizontal stabilizing means including a shaft horizontally supported in said housing to be freely rotatable; and a pair of cables, which are connected at its one ends to opposite end portions of said shaft, and wound around said shaft in opposite winding directions to each other, wherein under a suspended state of the load holder, said horizontal stabilizing means is operative to correct an inclination of said load holder in a horizontal position by unwinding a required length of one of said cables from said shaft and at the same time winding the same length of the other one around said shaft.

* * * * *